US006116557A

United States Patent [19]

Choy et al.

[11] Patent Number: 6,116,557

[45] Date of Patent: Sep. 12, 2000

[54] KEYBOARD SUPPORT SYSTEM

[75] Inventors: Andrew Lee Choy, San Francisco, Calif.; Stephen T. Brown, Lexington, Mass.

[73] Assignee: ACCO Brands, Inc., San Mateo, Calif.

[21] Appl. No.: 09/113,822

[22] Filed: Jul. 10, 1998

[51] Int. Cl.[7] ..... E04G 3/00; A47B 57/00

[52] U.S. Cl. ..... 248/286.1; 108/93; 248/284.1; 248/918

[58] Field of Search ..... 248/286.1, 281.11, 248/279.1, 918, 284.1; 108/75, 93, 69

[56] References Cited

U.S. PATENT DOCUMENTS

| | | | |
|---|---|---|---|
| 4,063,830 | 12/1977 | Ban | 403/3 |
| 4,157,876 | 6/1979 | DiGiulio | 403/90 |
| 4,201,427 | 5/1980 | Orr | 312/21 |
| 4,320,884 | 3/1982 | Leo | 248/276 |
| 4,379,429 | 4/1983 | Gubbe et al. | 108/5 |
| 4,384,532 | 5/1983 | Staff | 108/72 |
| 4,402,481 | 9/1983 | Sasaki | 248/276 |
| 4,431,329 | 2/1984 | Baitella | 403/55 |
| 4,453,687 | 6/1984 | Sweere | 248/183 |
| 4,568,052 | 2/1986 | Solomon et al. | 248/281.1 |
| 4,573,655 | 3/1986 | Vulic | 248/278 |
| 4,585,195 | 4/1986 | McFadden | 248/118 |
| 4,616,798 | 10/1986 | Smeenge et al. | 248/281.1 |
| 4,625,657 | 12/1986 | Little et al. | 108/93 |
| 4,632,349 | 12/1986 | Anstey | 248/281.1 |
| 4,645,155 | 2/1987 | Eldon et al. | 248/278 |
| 4,691,888 | 9/1987 | Cotterill | 248/284 |
| 4,706,919 | 11/1987 | Soberalski et al. | 248/281.1 |
| 4,736,689 | 4/1988 | Stanko | 108/5 |
| 4,776,284 | 10/1988 | McIntosh | 108/138 |
| 4,826,123 | 5/1989 | Hannah et al. | 248/248 |
| 5,031,867 | 7/1991 | Cotterill | 248/281.1 |
| 5,145,136 | 9/1992 | McConnell | 248/284.1 |
| 5,161,760 | 11/1992 | Terbrack | 248/118 |
| 5,176,351 | 1/1993 | Moore | 248/286 |
| 5,242,139 | 9/1993 | Aldrich | 248/118 |
| 5,257,767 | 11/1993 | McConnell | 248/284 |
| 5,292,097 | 3/1994 | Russell | 248/281.1 |
| 5,443,237 | 8/1995 | Stadtmauer | 248/441.1 |
| 5,483,898 | 1/1996 | Seidl | 108/3 |
| 5,490,466 | 2/1996 | Diffrient | 108/96 |
| 5,533,820 | 7/1996 | Ambrose | 400/472 |
| 5,582,375 | 12/1996 | Martin | 248/118.3 |
| 5,584,596 | 12/1996 | Greene | 403/55 |
| 5,588,375 | 12/1996 | Cotterill | 108/102 |
| 5,595,428 | 1/1997 | Huang | 312/223.3 |
| 5,836,560 | 11/1998 | Kaplan et al. | 248/286.1 |
| 5,839,373 | 11/1998 | Lin | 108/140 |
| 5,901,933 | 5/1999 | Lin | 248/285.1 |
| 5,924,664 | 7/1999 | Mileos et al. | 248/281.11 |
| 5,924,666 | 7/1999 | Liu | 248/286.1 |

*Primary Examiner*—Ramon O. Ramirez
*Assistant Examiner*—Anita M. King
*Attorney, Agent, or Firm*—Townsend and Townsend and Crew LLP

[57] ABSTRACT

A keyboard support system includes a tool-less, adjustable, in-board clamping apparatus for clamping a track to a base. The clamping apparatus includes clamps each having a clamp top slidable relative to and releasably engageable with a clamp bottom to clamp the track and the base therebetween. A clamp knob is adjustable to tighten and secure the clamp top and clamp bottom together. A positioning apparatus includes a slide coupled to the track for horizontal adjustment. The slide is connected to a shuttle which is coupled to an height adjustment arm for vertical height adjustment by an indexing rod. A keyboard tray for holding a keyboard is connected to a tray support which is coupled to the height adjustment arm for pitch adjustment by a guide rod. A clenching mechanism couples the movements of the indexing rod and guide rod and exerts a biasing force to bias the indexing rod and guide rod at selected height and pitch positions. The biasing force of the clenching mechanism is releasable by pulling on the keyboard tray with one hand for moving the indexing rod and guide rod for substantially simultaneous height and pitch adjustment.

22 Claims, 6 Drawing Sheets

KEYBOARD SUPPORT SYSTEM

BACKGROUND OF THE INVENTION

Keyboard positioning apparatus are commonly used to support keyboards associated with computer terminals and the like. The positioning apparatus is typically mounted to a desk and includes a keyboard support tray which is adjustable in the in-and-out horizontal, vertical, and/or pitch directions.

Conventional positioning apparatus employ fasteners for attachment beneath the desk. The use of fasteners such as screws requires holes to be drilled, and limits the apparatus to certain support surfaces that can receive the fasteners. It generally precludes the use of glass desk tops, for example. In addition, the attachment procedure can be complicated and time-consuming, and requires the use of tools. It is also inconvenient to change the location of attachment for the apparatus, because the fasteners are not readily removable. Although clamps can be used in place of fasteners, they protrude under the desk with a substantial length and can block the movement of the keyboard on the support tray when it is slid under the desk. The clamps must be mounted out-board to the sides of the keyboard support tray to avoid interfering with the keyboard. Out-board clamps thus require a larger area of attachment than fasteners, which are disposed in-board directly above the keyboard tray.

For adjustment in the horizontal, vertical, and pitch directions, conventional positioning apparatus typically employ knobs that are manually loosened and tightened for adjustment. The use of adjustment knobs requires the operator to use both hands to adjust the position of the keyboard: one for turning the knob and the other for holding the keyboard support tray. In addition, positioning apparatus of this type typically include multiple knobs for independent adjustment of the support tray in different directions. Therefore, use of conventional positioning apparatus can be rather complicated.

SUMMARY OF THE INVENTION

The present invention is directed to a keyboard support system which avoids the problems and disadvantages of the prior art. This goal is accomplished by providing a tool-less, adjustable, in-board clamping mechanism for releasably mounting the keyboard positioning apparatus to a support base without requiring holes to be drilled in the base. The clamping mechanism includes clamps each having a clamp top slidable relative to and releasably engageable with a clamp bottom to clamp a track of the positioning apparatus to the base. A clamp knob coupled to the clamp bottom is adjustable to tighten and secure the releasable engagement between the clamp top and clamp bottom. Further, the keyboard positioning apparatus is operable to adjust the in-and-out horizontal, vertical, and positions with only one hand. Horizontal adjustment is provided by a slide and a track. The positioning apparatus employs a clenching mechanism that couples height and pitch adjustments. The clenching mechanism is biased toward a locked position at selected height and pitch positions, and is releasable by one hand for adjusting the height and pitch positions.

According to an aspect of the present invention, an apparatus for supporting a keyboard relative to a base comprises a shuttle for connection to the base. The shuttle has a shuttle pivot hole and an indexing channel. A height adjustment arm has an arm slot, an indexing rod disposed in the indexing channel, and an arm guide slot. An anchor rod rotatably extends through the shuttle pivot hole and arm slot.

The anchor rod is slidable in the arm slot between a locked position where the indexing rod is locked into one of a plurality of index positions in the indexing channel and an unlocked position where the indexing rod is movable between the plurality of index positions in the indexing channel. A guide rod is slidably guided along the arm guide slot for supporting the keyboard. A clenching mechanism is connected between the anchor rod and the guide rod. The clenching mechanism is movable between a clenched position where the anchor rod is in the locked position and the guide rod is immobile relative to the arm guide slot and an unclenched position where the anchor rod is in the unlocked position and the guide rod is mobile relative to the arm guide slot. The clenching mechanism is biased toward the clenched position and releasable by a force on the keyboard support.

According to another aspect of the invention, an apparatus for supporting a keyboard relative to a base comprises a shuttle for connection to the base. The shuttle has a shuttle pivot hole. An arm has an arm slot, and arm pivot hole, and an arm guide slot. An anchor rod rotatably extends through the shuttle pivot hole and arm slot. The anchor rod is slidable in the arm slot between a locked position and an unlocked position. A keyboard support is rotatably coupled to the height adjustment arm at the arm pivot hole and has a guide rod which is slidably guided along the arm guide slot for supporting the keyboard. A clenching mechanism is connected between the anchor rod and the guide rod. The clenching mechanism is movable between a clenched position where the anchor rod is in the locked position and the guide rod is immobile relative to the arm guide slot and an unclenched position where the anchor rod is in the unlocked position and the guide rod is mobile relative to the arm guide slot. The clenching mechanism is biased toward the clenched position and releasable by a force on the keyboard support.

In accordance with another aspect of the invention, an apparatus for supporting a keyboard relative to a base comprises a shuttle connectable to the base. The shuttle has an indexing channel which includes a plurality of index positions. A height adjustment arm has an indexing rod which is engageable with and movable between the plurality of index positions of the indexing channel to adjust a height position of the height adjustment arm relative to the shuttle. A keyboard support is rotatably coupled to the height adjustment arm to adjust a pitch position of the keyboard support relative to the height adjustment arm. The apparatus further includes a mechanism, coupled to the shuttle, height adjustment arm and keyboard support, for releasably biasing the height adjustment arm to engage the indexing rod with one of the plurality of index positions of the indexing channel for locking the height position of the height adjustment arm and the pitch position of the keyboard support. The mechanism is releasable by a force exerted on the keyboard support for adjusting the height position of the height adjustment arm and the pitch position of the keyboard support.

Another aspect of the invention is a method for adjusting the position of a keyboard supported on a keyboard support using one hand. The keyboard support is rotatably coupled to a height adjustment arm which is movable relative to a support base for height adjustment. The keyboard support and height adjustment arm are commonly biased in a first direction toward a locked position. The method comprises the step of applying a force on the keyboard support in a second direction which is substantially opposite from the first direction to substantially simultaneously move the height adjustment arm and the keyboard support to an unlocked position. The keyboard support is moved relative to the support base to adjust a position of the keyboard support. The force on the keyboard support in the second direction is released to return the keyboard support and height adjustment arm to the biased locked position.

Another aspect of the invention is a clamping apparatus for clamping a track to a base which has at least one clamp. Each clamp comprises a clamp bottom having an aperture spaced from an engagement opening. A clamp top has a top portion spaced from the clamp bottom and a side portion coupled to the engagement opening of the clamp bottom to adjust a clamp spacing between the top portion of the clamp top and the clamp bottom for holding the track and base. The side portion has a surface which is releasably engageable with the engagement opening. A clamp knob has a screw portion adjustably coupled to the aperture of the clamp bottom to protrude into the clamp spacing.

Yet another aspect of this invention is a clamp for clamping a track to a base. The clamp comprises a clamp bottom having an opening with an engagement edge. A clamp top has a top portion spaced from the clamp bottom by a clamp spacing and a side portion slidably coupled to the opening of the clamp bottom. The side portion has a corrugated surface which is releasably engageable with the engagement edge of the opening. The clamp further includes a mechanism, coupled to the clamp bottom, for detachably supporting the clamp bottom relative to the clamp top to secure engagement between the corrugated surface and engagement edge at selected clamp spacings between the clamp top and clamp bottom.

BRIEF DESCRIPTION OF THE DRAWINGS

The preferred embodiments of this invention, illustrating all their features, will now be discussed in detail. These embodiments depict the novel and nonobvious keyboard support system of this invention shown in the accompanying drawings, which are included for illustrative purposes only. These drawings include the following figures, with like numerals indicating like parts.

DETAILED DESCRIPTION OF THE INVENTION

Figure 1:
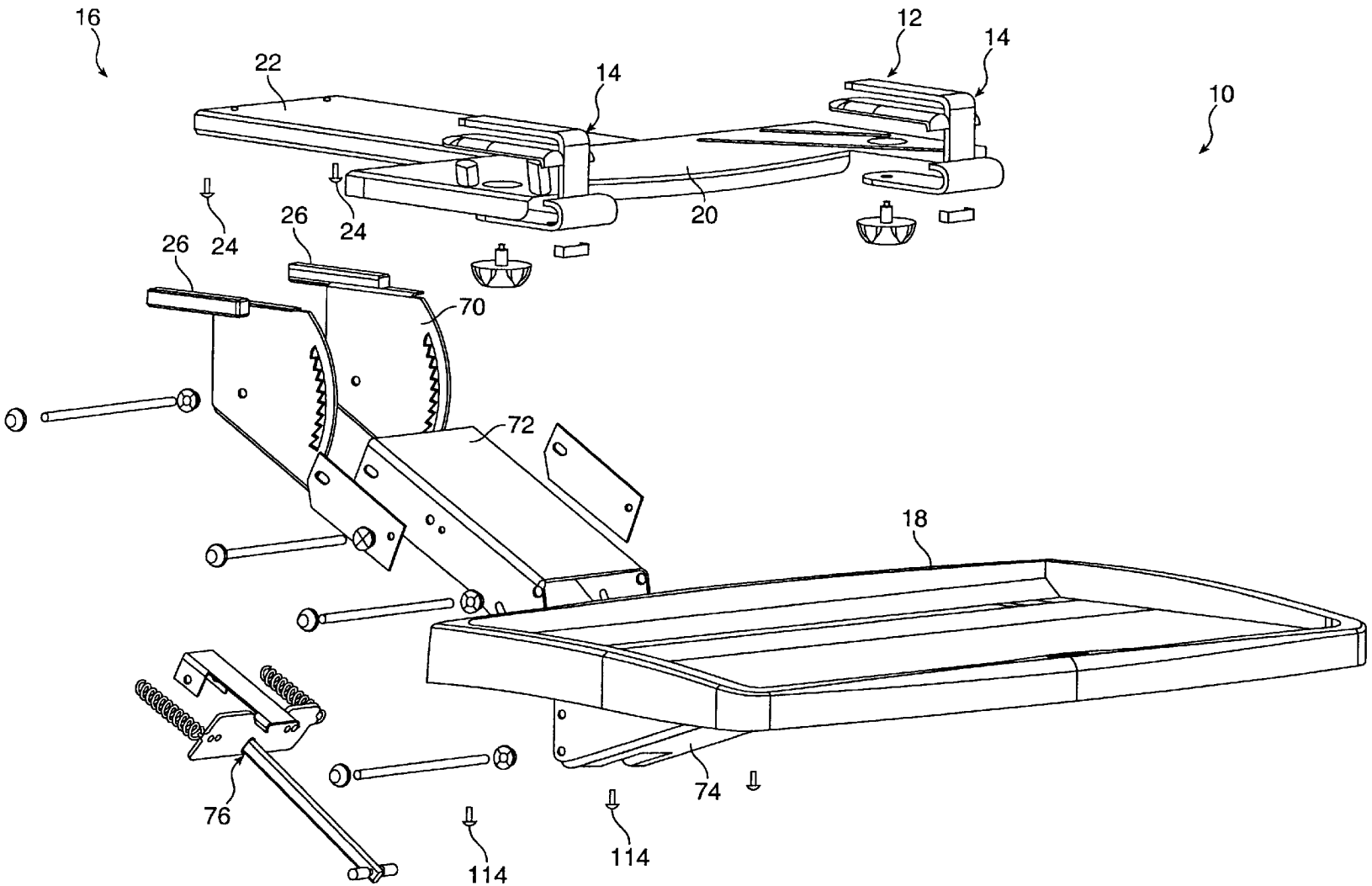
FIG. 1 is an exploded perspective view of a keyboard support system in accordance with an embodiment of the present invention.
Figure 4:
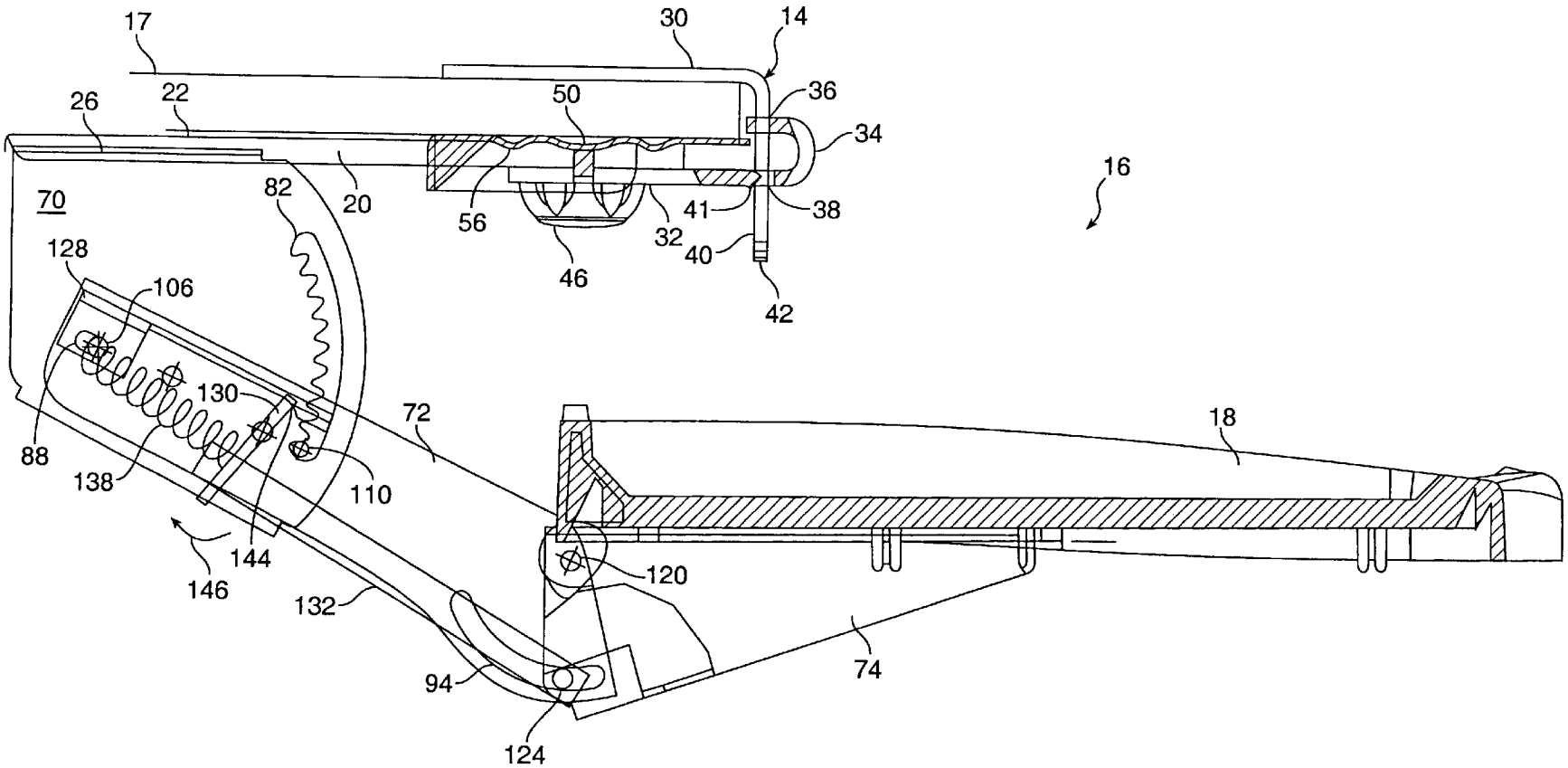
FIG. 4 is a schematic elevational view of the keyboard support system of FIG. 1 assembled in a locked position.
Figure 5:
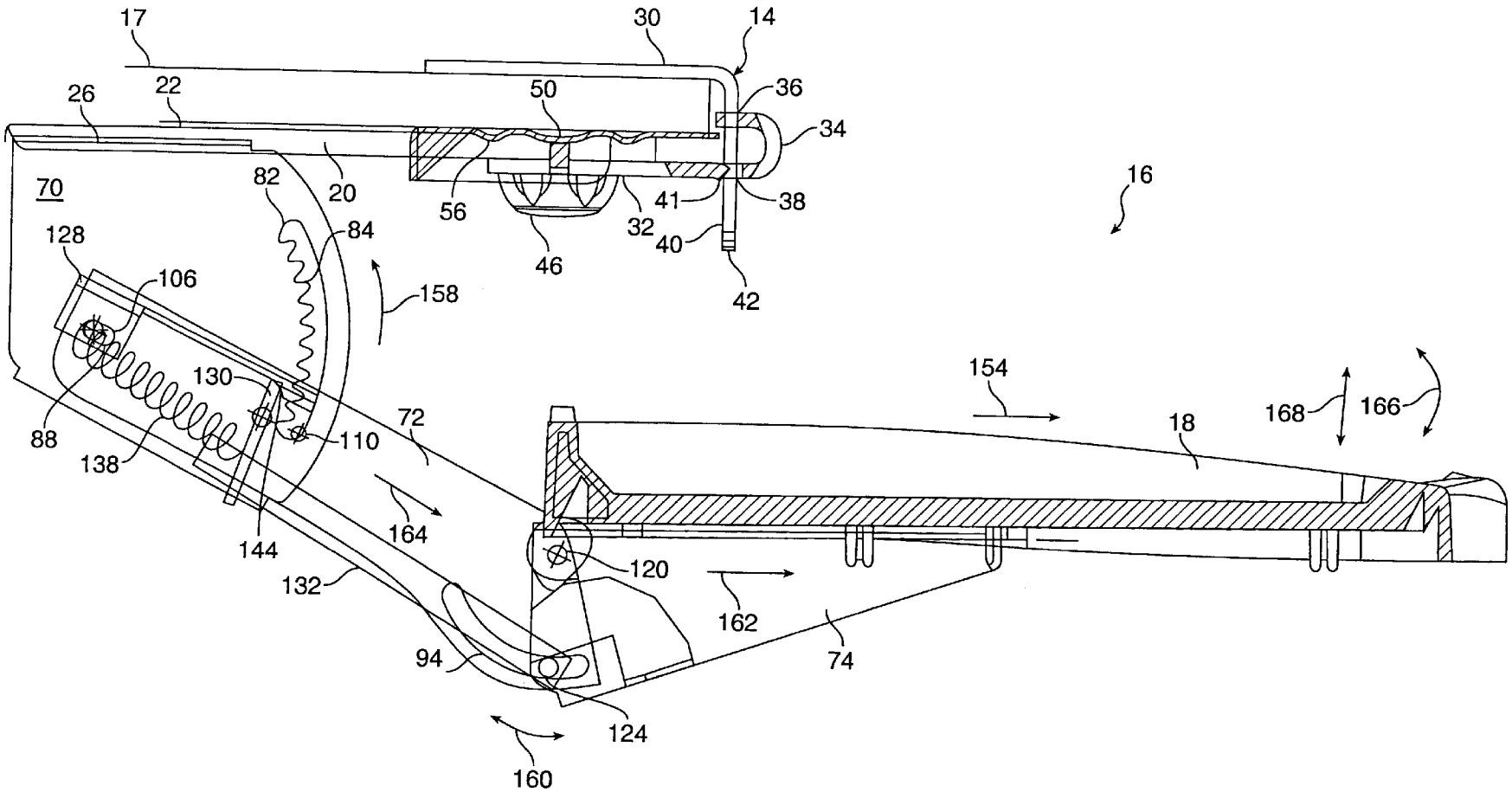
FIG. 5 is a schematic elevational view of the keyboard support system of FIG. 4 in an unlocked position.

FIG. 1 shows a keyboard support system 10 which includes a clamping mechanism 12 having a pair of clamps 14 for releasably mounting a keyboard positioning apparatus 16 to the bottom surface of a support base 17 (see FIGS. 4 and 5). The keyboard positioning apparatus 16 has a support tray 18 for supporting a keyboard (not shown). The support tray 18 preferably is large enough to hold a mouse as well as the keyboard, and includes openings in the rear portion for accommodating cables for the keyboard and mouse (not shown).

The portion of the keyboard positioning apparatus 16 which is mounted by the clamping mechanism 12 is a track support 20. The track support 20 is generally T-shaped and includes a track 22 with a pair of track screws 24. The track 22 supports a slide 26 when assembled for in-and-out horizontal adjustment of the support tray 18 which is coupled to the slide 26 relative to the track support 20. In this embodiment, the track 22 has two parallel track portions for guiding two slide portions of the slide 26. The movement of the slide 26 is limited to the length of the track 22 which is defined at one end by the track screws 24 and at the other end by the track support 20. The keyboard positioning apparatus 16 further provides vertical and pitch adjustments of the support tray 18 as discussed in more detail below.

As shown in FIG. 1, the width of the track support 20 is generally equal to or less than the width of the support tray 18. The pair of clamps 14 are spaced across the width of the track support 20, and are disposed generally within the width of the support tray 18. In this way, the support tray 18 will slide directly below the clamps 14 when it is pushed inward. It is important to maintain sufficient clearance between the clamps 14 and the support tray 18 to prevent interference between the clamps 14 and the keyboard on the tray 18. The clamping mechanism 12 having this characteristic is referred to as an in-board mechanism as opposed to an out-board mechanism in which the clamps would be spaced beyond the width of the tray (not shown). In an out-board mechanism, interference of movement between the clamps and the keyboard on the tray is not of concern because they do not overlap in position. The clamps of an out-board mechanism require more space for mounting, which may not be available or desirable. The present invention advantageously provides an in-board clamping mechanism 12 by solving the problem of interference as described below.

Clamping Mechanism

Figure 2:
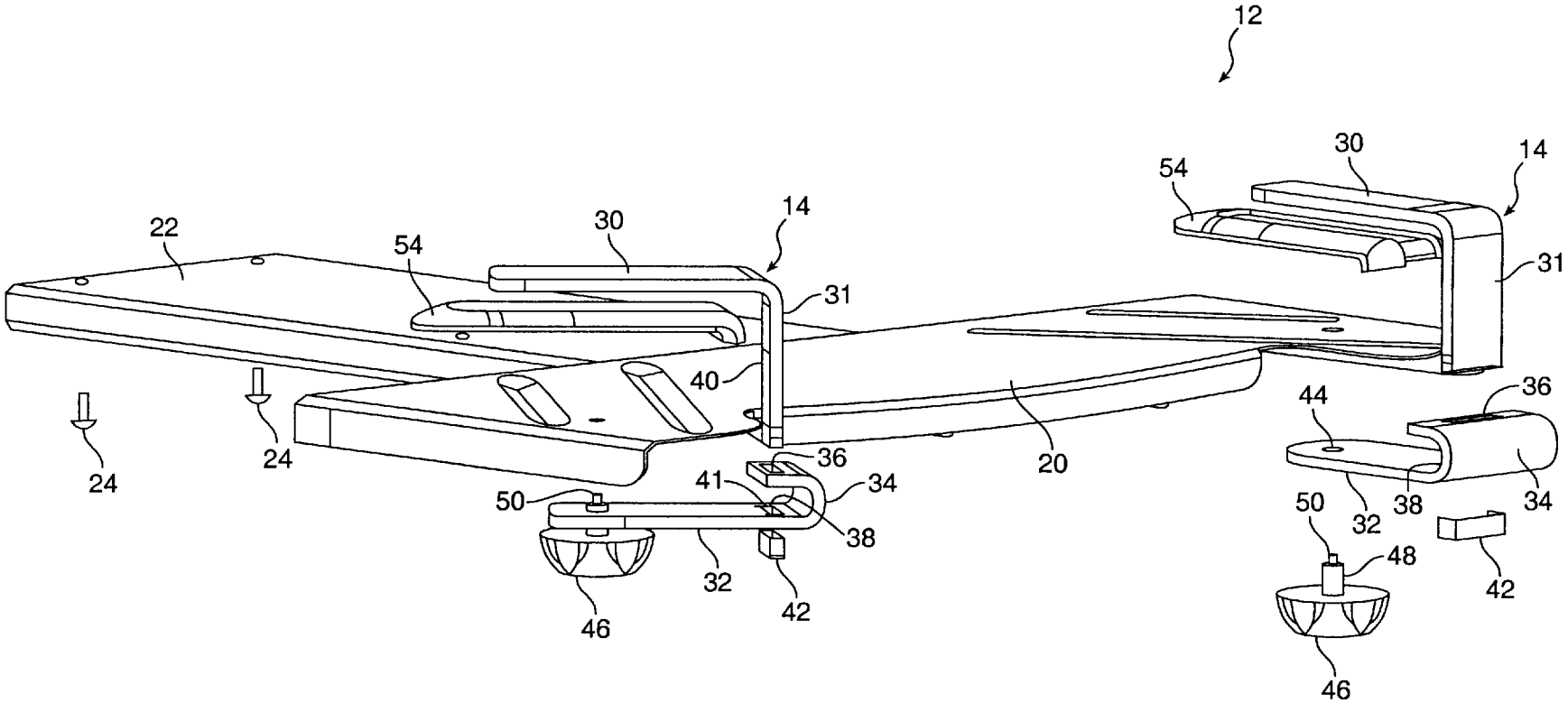
FIG. 2 is an exploded perspective view of a clamping mechanism of the keyboard support system of FIG. 1.

As shown more clearly in the exploded view of FIG. 2, each clamp 14 of the clamping mechanism 12 includes a clamp top 30 slidably coupled to a clamp bottom 32. The clamp top 30 and clamp bottom 32 are typically disposed horizontally. The clamp top 30 is bent, desirably into a general L-shape, with a clamp slide portion 31 which extends downward to the clamp bottom 32.

In this embodiment, the clamp bottom 32 includes a folded portion 34 having an upper opening 36 disposed above and substantially aligned with an engagement opening 38 in the lower portion of the clamp bottom 32. The clamp slide portion 31 of the clamp top 30 extends slidably through the pair of openings 36, 38 to adjust a clamp spacing between the clamp top 30 and clamp bottom 32. Because of the approximately 90° bend in the clamp top 30, the sliding displacement between the clamp top 30 and clamp bottom 32 is substantially vertical. Other embodiments may include a sloped slide portion 31 so that the displacement is slanted. The clamp slide portion 31 is engageable with the clamp bottom 32 to lock into a selected clamp spacing between the clamp top 30 and clamp bottom 32. In this embodiment, the clamp slide portion 31 has a toothed or corrugated surface 40 which is engageable with an angled engagement edge 41 of the engagement opening 38 of the clamp bottom 32 (which is best seen in FIGS. 4 and 5).

A clamp cap 42 is preferably provided at the end of the clamp slide portion 31. The clamp cap 42 has a size that prevents it from passing through the openings 36, 38. When assembled, the clamp cap 42 prevents the clamp bottom 32 from slipping off the clamp top 30. The clamp bottom 32 further includes a threaded aperture 44 for receiving a clamp knob 46. The clamp knob 46 has a screw portion 48 that is adjustably coupled with the threaded aperture 44 and has a screw tip 50 that protrudes through the aperture 44 into the clamp spacing.

In use, the clamp slide portion 31 of the clamp top 30 is inserted through the openings 36, 38 of the folded portion 34 of the clamp bottom 32. During insertion, the clamp slide portion 31 will generally need to be tilted or bent slightly so that the angled edge 41 of the opening 38 does not get caught in the corrugations of the corrugated surface 40. The engagement opening 38 is sufficiently large to allow the clamp slide portion 31 to pass through in a tilted or bent manner. The folded portion 34 advantageously provides a stable and precise guide for the clamp slide portion 31 to facilitate smooth, accurate adjustment of the clamp spacing. The clamp top 30 and clamp bottom 32 are brought sufficiently close together to clamp the track support 20 and base 17 therebetween (as best seen in FIGS. 4 and 5). An optional clamp foot 54 may be provided between the clamp top 30 and the support base 17. The clamp foot 54 preferably has a larger surface area than the clamp top 30 to provide more stable clamping and distribute the clamp forces more evenly on the base 17.

The engagement between the corrugated surface 40 of the clamp top 30 and engagement edge 41 of the clamp bottom is releasable. To securely clamp the track support 20 to the base 17, the clamp knob 46 is tightened toward the track support 20 until the screw tip 50 bears against a recessed surface 56 of the support 20, as best seen in FIGS. 4 and 5. This clamp knob 46 exerts a force on the clamp bottom 32 to ensure a secure engagement between the corrugated surface 40 and the angled edge 41. Because the clamp top 30 is slidably coupled to the clamp bottom 32 via the clamp slide portion 31 to accommodate different clamp spacings, the clamp knob 46 can be very short. Consequently, the clamp knob 46 does not need to extend far below the track support 20 and facilitates inboard clamping without interference problems. The short clamp knob 46 also protects the clamp 14 by limiting torque forces it sustains.

The clamping mechanism 12 is easily adjustable by releasing the clamp knob 46. In addition, because the clamp top 30 and clamp bottom 32 of each clamp 14 are free to swivel laterally, the pair of clamps 14 can be oriented nonparallel to one another to facilitate corner mounting to a corner rather than a straight edge of the support base 17. The clamping mechanism 12 does not require holes to be drilled in the base 17. Installation of the clamping mechanism 12 is simple and fast, and does not require any tools. The components of the mechanism 12 can be made of a variety of materials, such as plastics, metals, and the like.

Keyboard Positioning Apparatus

Figure 3:
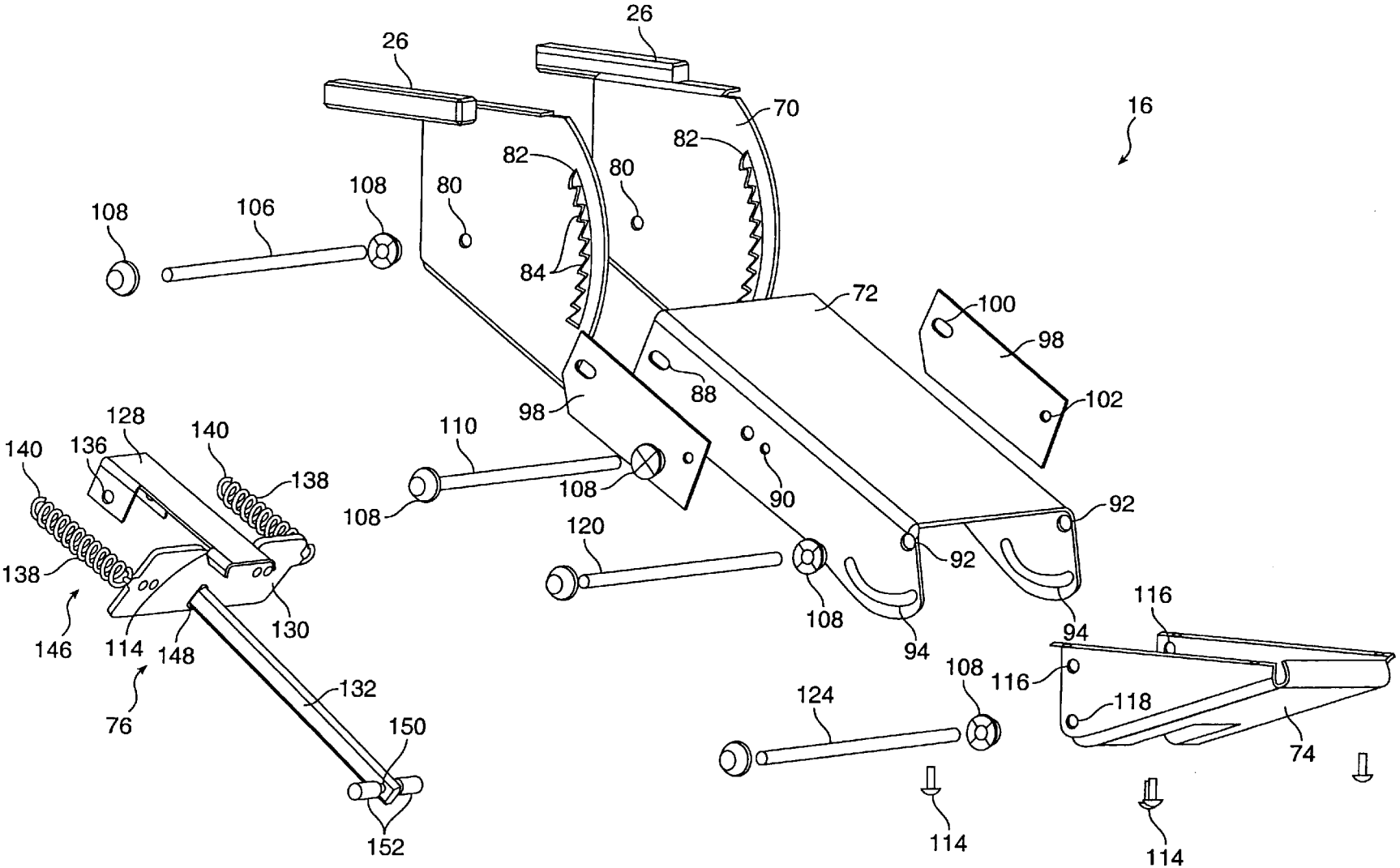
FIG. 3 is an exploded perspective view of a keyboard positioning apparatus of the keyboard support system of FIG. 1.

Referring to the exploded view of FIG. 3, the keyboard positioning apparatus 16 includes a shuttle 70, a height adjustment arm 72, a keyboard tray support 74, and a clenching mechanism 76 which are coupled together. When assembled, the height adjustment arm 72 is disposed outward of the shuttle 70 and inward of the keyboard tray 18 and tray support 74, as shown in FIG. 1. The terms "inward" and "outward" are used to denote relative positions, and are defined with respect to the support base 17. The structure and coupling among these components are described below, followed by a discussion on the operation of the keyboard positioning apparatus 16.

1. Shuttle

As shown in FIG. 3, the shuttle 70 has a pair of identical shuttle portions that are connected to the two slide portions 26. Each shuttle portion 70 includes a shuttle pivot hole 80 and an indexing channel 82. The indexing channel 82 includes a plurality of index positions defined by toothed index slots 84. The index slots 84 are desirably angled slightly upward for reasons that will be discussed below in connection with the operation of the positioning apparatus 16. The indexing channel 82 is desirably curved and centered relative to the shuttle pivot hole 80, although other configurations are possible.

2. Height Adjustment Arm

The height adjustment arm 72 of the positioning apparatus 16 preferably has two identical arm portions connected together, as best seen in FIG. 3. Each height adjustment arm portion 72 has an arm slot 88, an indexing aperture 90, an arm pivot hole 92, and an arm guide slot 94 (which is best seen in FIGS. 4 and 5). The arm guide slot 94 is curved and centered relative to the arm pivot hole 92. A pair of shims 98 are preferably provided, and include shim slots 100 that correspond to the arm slots 88, and shim apertures 102.

When assembled, the height adjustment arm 72 is sandwiched partially within the two shuttle portions 70, which are in turn sandwiched between the pair of shims 98. An anchor rod 106 with tinnermans 108 extends through the arm slots 88 of the height adjustment arm 72, the shim slots 100 of the shims 98, and the shuttle pivot holes 80 of the shuttle 70, thereby rotatably coupling these components together. An indexing rod 110 with tinnermans 108 extends through the indexing apertures 90 of the height adjustment arm 72, the shim apertures 102, and the indexing channels 82 of the shuttle 70. The indexing rod 110 further constrains the relative movements between the three components, being movable only within the boundaries of the indexing channels 82. The arm pivot hole 92 and arm guide slots 94 are disposed outward of the shuttle 70.

The indexing rod 110 is slidable within the indexing channels 82 in an unlocked position when it is not engaged with one of the pairs of the index slots 84 of the shuttle portions 70. The indexing rod 110 is locked when it is engaged with the pair of index slot 84, thereby preventing relative movement between the height adjustment arm 72 with shims 98 and the shuttle 70. When the indexing rod 110 moves in and out of the index slots 84, the height adjustment arm 72 and shims 98 move with the indexing rod 110 relative to the shuttle 70. This relative movement is accommodated by the arm slots 88 and corresponding shim slots 100. These slots provide freedom of sliding movement of the anchor rod 106 therein to facilitate relative movement between the locked position and the unlocked position of the indexing rod 110. As described in more detail below, the movement of the height adjustment arm 72 relative to the shuttle 70 facilitated by the indexing rod 110 allows height adjustment of the keyboard tray 18. The index slots 84 are height positions that can be selected for height adjustment. The available height adjustment is determined by the angular span of the curved indexing channels 82 as well as its radius of curvature with respect to the shuttle pivot hole 80. In this embodiment, the available height adjustment has a range of at least about 8 inches, but the range may be smaller or larger. A releasable biasing force is advantageously provided to bias the indexing rod 110 toward a locked position in a selected pair of index slots 84.

As can be appreciated, the use of pairs of shuttle portions 70 and height adjustment arm portions 72 as well as the use of the shims 98 is desirable for improved structural stability and performance. Other modifications can be easily made without departing from the scope of the invention.

3. Keyboard Tray Support

The keyboard tray support 74 is connected to the keyboard tray 18 by tray screws 114 (as shown in FIG. 1). The tray support 74 preferably includes a pair of connected portions, each of which includes a tray support pivot hole 116 and a tray support aperture 118, as best seen in FIG. 3.

When assembled, the tray support 74 is sandwiched partially between the height adjustment arm portions 72. A pivot rod 120 with tinnermans 108 extends through the tray support pivot holes 116 and the arm pivot holes 92 of the height adjustment arm 72. The pivot rod 120 rotatably couples the tray support 74 with the height adjustment arm 72. A guide rod 124 with tinnermans 108 extends through the tray support apertures 118 and arm guide slots 94 of the height adjustment arm 72. The rotational movement between the tray support 74 and height adjustment arm 72 facilitates the pitch adjustment of the keyboard tray 18, which is guided by the sliding movement of the guide rod 124 within the arm guide slots 94. The angular span of the arm guide slots 94 defines the limits of pitch adjustment. In this embodiment, the available pitch adjustment range as defined by the angular span is approximately 90°. As described in more detail below, a releasable sustaining force is advantageously provided to maintain or lock the guide rod 124 in a selected pitch position.

4. Clenching Mechanism

The clenching mechanism 76 provides the releasable biasing force for biasing the indexing rod 110 in a selected height position of the indexing channels 82 to lock the height adjustment arm 72 at the selected height position relative to the shuttle 70. The mechanism also generates the releasable sustaining force for maintaining the guide rod 124 in a selected pitch position of the arm guide slots 94 to lock the tray support 74 at the selected pitch position relative to the height adjustment arm 72. This single mechanism advantageously couples height adjustment with pitch adjustment to allow them to be performed substantially simultaneously with only one hand. To accomplish this, the clenching mechanism 76 couples the indexing rod 110 (which is the height adjustment rod) and the guide rod 124 (which is the pitch adjustment rod). The indexing rod 110 and guide rod 124 in turn govern relative movements of the shuttle 70, height adjustment arm 72, and tray support 74.

The clenching mechanism 76 in the embodiment shown in FIG. 3 includes a trip 128 connected to a keeper 130 which is coupled to a slide shaft 132. The trip 128 preferably includes two trip portions having trip apertures 136. At least one spring is connected at one end to the keeper 130. FIG. 3 shows a pair of springs 138 that extend generally parallel to the trip 128 and substantially transverse to the keeper 130. The free ends 140 of the springs 138 are substantially aligned with the trip apertures 136. The trip 128 includes a trip edge 144 at the connection with the keeper 130 (as best seen in FIGS. 4 and 5). The trip edge 144 bears against the keeper 130 to substantially prevent relative movement therebetween except for slight tilting of the keeper 130 in the direction indicated by arrow 146.

The keeper 130 includes a keeper slot 148 through which the slide shaft 132 extends substantially transversely. The keeper slot 148 is slightly larger than the cross section of the slide shaft 132 to allow the slide shaft 132 to slide freely therethrough when the keeper 130 is substantially transverse to the slide shaft 132. When the keeper 130 is tilted, however, the keeper slot 148 bears obliquely against the slide shaft 132 to clench the slide shaft 132 and prevent it from sliding therethrough. The slide shaft 132 extends from the keeper 130 and includes a slide shaft aperture 150 near an end opposite from the trip 128. The slide shaft 132 desirably includes a pair of apertured spacers 152 adjacent the slide shaft aperture 150.

When assembled, the clenching mechanism 76 is substantially housed within the height adjustment arm 72. The anchor rod 106 extends through the free ends 140 of the springs 138 and the trip apertures 136, thereby rotatably coupling the trip 128 and springs 138 with the height adjustment arm 72 and shuttle 70 (via the arm slots 88 and shuttle pivot holes 80, respectively). At the other end of the clenching mechanism 76, the guide rod 124 extends through the slide shaft aperture 150 and spacers 152, thereby rotatably coupling the slide shaft 132 with the height adjustment arm 72 and tray support 74 (via the arm guide slots 94 and tray support apertures 118, respectively). The spacers 152 space the slide shaft 132 along the guide rod 124 between the tray support portions 74 to prevent lateral sliding of the slide shaft 132 in the direction of the guide rod 124. This maintains the alignment of the slide shaft 132 relative to the keeper slot 148 and prevents locking or clenching of the slide shaft 132 by the side edges of the keeper slot 148 as a result of lateral sliding. Therefore, clenching of the slide shaft 132 occurs only with a tilting of the keeper 130 in the direction 146 shown in FIG. 3.

5. Operation of the Keyboard Positioning Apparatus

The operation of the keyboard positioning apparatus will be discussed in connection with FIGS. 4 and 5. FIG. 4 shows the keyboard positioning apparatus 16 in a locked position at selected height and pitch of the keyboard support 74. In FIG. 5, the positioning apparatus 16 is in an unlocked position for height and pitch adjustment.

While at rest, the springs 138 anchored to the shuttle 70 at the shuttle pivot hole 80 exert a spring force on the keeper 130 to tilt the keeper 130 in the direction 146, as best seen in FIG. 4. This causes the keeper slot 148 to clench the slide shaft 132 to prevent it from sliding. Because the slide shaft 132 is coupled to the tray support 74 through the guide rod 124, the clenching of the slide shaft 132 produces a sustaining force that maintains the guide rod 124 in a selected pitch position of the arm guide slots 94. This in turn locks the tray support 74 at the selected pitch position relative to the height adjustment arm 72. Furthermore, the spring biasing force of the springs 138 is transferred to the slide shaft 132 as well. Because the slide shaft 132 is coupled by the guide rod 124 to the height adjustment arm 72, the spring force is transferred from the slide shaft 132 through the guide rod 124 to the height adjustment arm 72 and the indexing rod 110 which is connected to the height adjustment arm 72. This biasing force biases the indexing rod 110 toward a locked position in one of the selected index positions 84 of the indexing channels 82.

The sustaining force and biasing force exerted by the springs 138 are releasable in that the springs 138 can be stretched by an external force to remove the sustaining and biasing forces. This external force can be applied to the keyboard tray 18 as illustrated in FIG. 5. The force is typically a pulling force in the general direction of arrow 154. The operator can pull the keyboard tray 18 with both hands. Advantageously, one hand is sufficient to exert the force required for adjusting the keyboard positioning apparatus 16. As shown in FIG. 5, the positioning apparatus provides in-and-out horizontal adjustment along arrow 156 of the slide relative to the track 22, vertical height adjustment along arrow 158 of the height adjustment arm 72 relative to the shuttle 70, and pitch adjustment along arrow 160 of the tray support 74 relative to the height adjustment arm 72. It is noted that because the indexing channels 82 are curved, the height adjustment along arrow 156 actually produces some horizontal and pitch adjustment components in addition to height adjustment. The horizontal and pitch adjustment components can be canceled out or compensated for by the horizontal and pitch adjustments.

When the keyboard tray 18 is pulled in the general direction of arrow 154, the external force is transferred to the tray support 74 generally along arrow 162, which is in turn transferred to the height adjustment arm 72 and slide shaft 132 generally along arrow 164. This force is generally opposite to the spring force of the springs 138, and releases the spring force. When that happens, the keeper 130 rotates from the tilted position so that the keeper slot 148 unclenches the slide shaft 132 in an unclenched position, as illustrated in FIG. 5. The slide shaft 132 slides freely through the keeper slot 148 and releases the sustaining force on the guide rod 124, freeing the tray support 74 and the keyboard tray 18. The unclenched slide shaft 132 enables the guide rod 124 to slide along the arm guide slot 94 for pitch adjustment of the keyboard tray 18 relative to the height adjustment arm 72. The operator can exert an external pitching force on the keyboard tray 18 along arrow 166 to make the pitch adjustment.

Figure 6A:
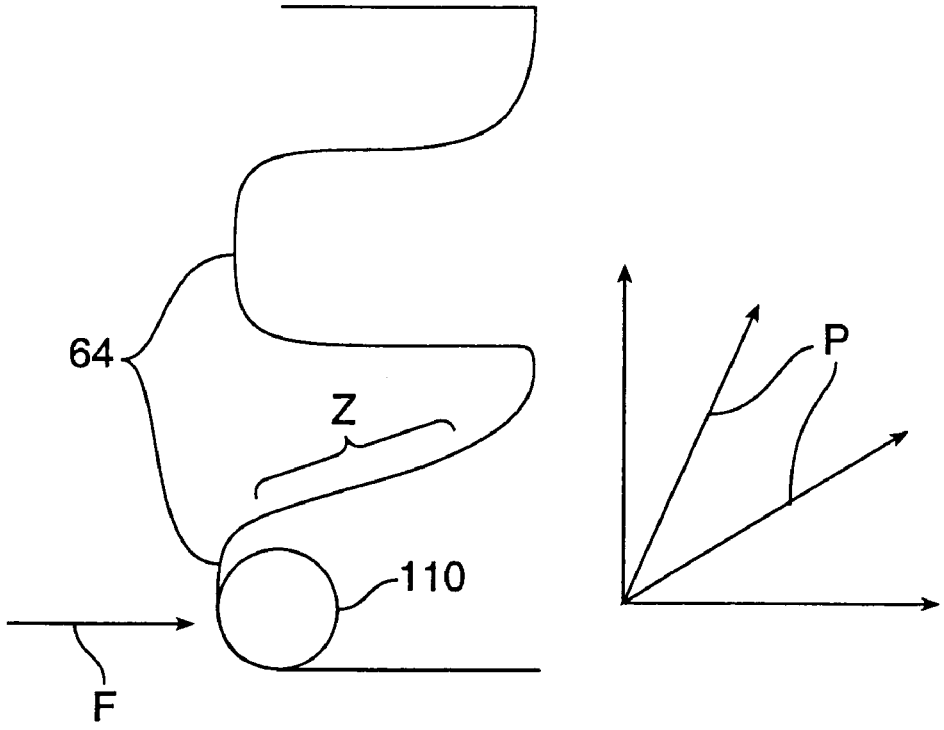
FIG. 6*a* schematically illustrates the upward angling of the toothed index slots in the keyboard support system of FIG. 4 in accordance with an embodiment of the invention.
Figure 6B:
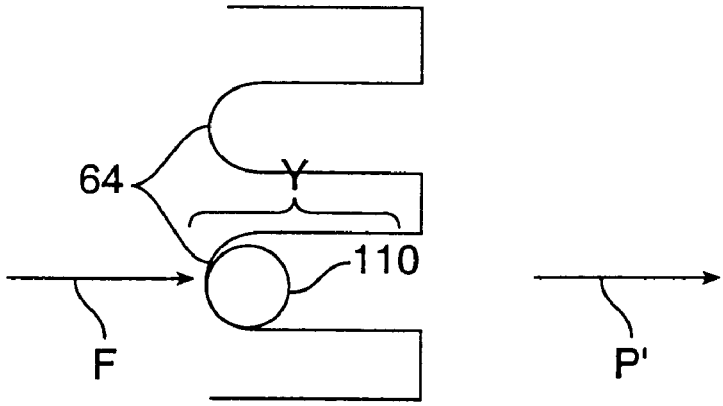
FIG. 6*b* schematically illustrates flat toothed index slots in the keyboard support system of FIG. 4 in accordance with another embodiment of the invention.

At the same time, the indexing rod 110 is disengaged and unlocked from the indexing position 84 of the indexing channels 82 when the spring forces are released. A generally vertical force along arrow 168 exerted on the keyboard tray 18 will cause the height adjustment arm 72 together with the indexing rod 110 to swing relative to the shuttle pivot rod 120 for height adjustment. The indexing rod 110 slides along the indexing channels 82 until the desired height is attained. The upward angling of the toothed index slots 84 allows better transfer of the external pulling force to the indexing rod 110 to disengage it from the index slots 84. This is best illustrated in FIGS. 6*a* and 6*b*. In FIG. 6*a*, the toothed index slots 64 have an upward angled profile Z which provides a quadrant of pulling forces P to generate a force F to disengage the indexing rod 110 and unlock the mechanism. A user can thus disengage the indexing rod 110 with undifferentiated movements within this quadrant, so that a force pulling "up" as well as "out" will release the indexing rod 110. In contrast, if the toothed index slots 64 have a flat profile Y, as shown in FIG. 6*b*, then the pulling forces to generate a force F to disengage the indexing rod 110 are limited in the direction P'. As a result, the user must use substantially more precise movements to disengage the indexing rod 110. This is particularly difficult at lower positions of the indexing channels 82, where a pulling force that is inclined downward is required. The downward direction is not a natural direction of force for the operator, who is more prone to exert a pulling force that is inclined upward. The upward angled toothed index slots 84 are thus desirable to facilitate smooth height adjustment.

In-and-out horizontal adjustment can be made by a force exerted on the shuttle 70 which is connected to the slide or by a force on the keyboard tray 18. In the latter case, the pulling force is transferred from the keyboard tray 18 through the height adjustment arm 72 and shuttle 70 to the slide. The horizontal adjustment can be made substantially simultaneously with the height and pitch adjustments.

After the operator completes the adjustments, the external forces are removed. The springs 138 assert the spring force on the keeper 130, which indirectly generates the biasing force for biasing the indexing rod 110 in the selected height position of the indexing channels 82 and the sustaining force for maintaining the guide rod 124 in the selected pitch position of the arm guide slots 94. This concludes the keyboard positioning procedure.

The keyboard positioning apparatus 16 provides easy and simple adjustments without the use of manual knobs or levers. The components of the apparatus 16 can be made of a variety of materials including plastics, metals, and the like.

The above-described arrangements of apparatus and methods are merely illustrative of applications of the principles of this invention and many other embodiments and modifications may be made without departing from the spirit and scope of the invention as defined in the claims. For example, while the clenching mechanism 76 has been described to bias both the height adjustment arm 72 to a height position and the keyboard support 74 to a pitch position, it can be used to bias only the height adjustment arm 72 or only the keyboard support 74 in a different embodiment.

What is claimed is:

1. An apparatus for supporting a keyboard relative to a base, the apparatus comprising:

a shuttle for connection to the base, the shuttle having a shuttle pivot hole and an indexing channel;

a height adjustment arm having an arm slot, an indexing rod disposed in the indexing channel, and an arm guide slot;

an anchor rod rotatably extending through the shuttle pivot hole and arm slot, the anchor rod slidable in the arm slot between a locked position where the indexing rod is locked into one of a plurality of index positions in the indexing channel and an unlocked position where the indexing rod is movable between the plurality of index positions in the indexing channel;

a guide rod slidably guided along the arm guide slot for supporting the keyboard; and a clenching mechanism connected between the anchor rod and the guide rod, the clenching mechanism movable between a clenched position where the anchor rod is in the locked position and the guide rod is immobile relative to the arm guide slot and an unclenched position where the anchor rod is in the unlocked position and the guide rod is mobile relative to the arm guide slot, the clenching mechanism biased toward the clenched position and releasable by a force on the keyboard support.

2. The apparatus of claim 1, further comprising a keyboard support rotatably coupled to the height adjustment arm at an arm pivot hole and connected to the guide rod.

3. The apparatus of claim 1, wherein the clenching mechanism comprises a trip having an end rotatably coupled to the anchor rod and a slide shaft having an end rotatably connected to the guide rod, the slide shaft being coupled to the trip to be mobile relative to the arm guide slot in the unclenched position and immobile relative to the arm guide slot in the clenched position.

4. The apparatus of claim 3, wherein the clenching mechanism comprises a keeper having an opening slidably coupled to the slide shaft and being rotatably coupled to the trip to rotate relative to the slide shaft between a clench angle at the clenched position where the opening of the keeper clenches the slide shaft and an unclench angle at the unclenched position where the keeper unclenches the slide shaft.

5. The apparatus of claim 4, wherein the clenching mechanism comprises a spring connected between the anchor rod and the keeper, the spring biasing the keeper toward the clench angle relative to the slide shaft and biasing the indexing rod toward the locked position.

6. The apparatus of claim 1, wherein the indexing channel is curved and substantially centered relative to the shuttle pivot hole.

7. The apparatus of claim 1, wherein the indexing channel comprises a plurality of teeth and the plurality of index positions are defined between adjacent pairs of the teeth.

8. The apparatus of claim 7, wherein the plurality of teeth are skewed.

9. The apparatus of claim 8 wherein the plurality of teeth of the indexing channel are skewed upward.

10. The apparatus of claim 1, wherein the shuttle comprises a slide for sliding connection with a track mounted on the base.

11. An apparatus for supporting a keyboard relative to a base, the apparatus comprising:

a shuttle for connection to the base, the shuttle having a shuttle pivot hole;

an arm having an arm slot, an arm guide slot, and an arm pivot hole;

an anchor rod rotatably extending through the shuttle pivot hole and arm slot, the anchor rod slidable in the arm slot between a locked position and an unlocked position;

a keyboard support rotatably coupled to the arm at the arm pivot hole and having a guide rod slidably guided along the arm guide slot for supporting the keyboard; and a clenching mechanism connected between the anchor rod and the guide rod, the clenching mechanism movable between a clenched position where the anchor rod is in the locked position and the guide rod is immobile relative to the arm guide slot and an unclenched position where the anchor rod is in the unlocked position and the guide rod is mobile relative to the arm guide slot, the clenching mechanism biased toward the clenched position and releasable by a force on the keyboard support.

12. The apparatus of claim 11, wherein the shuttle further includes an indexing channel, the arm further includes an indexing rod disposed in the indexing channel, and the indexing rod is locked into one of a plurality of index positions in the indexing channel when the anchor rod is in the locked position and the indexing rod is movable between the plurality of index positions in the indexing channel when the anchor rod is in the unlocked position.

13. The apparatus of claim 11, wherein the arm guide slot is curved and substantially centered relative to the arm pivot hole.

14. An apparatus for supporting a keyboard relative to a base, the apparatus comprising:

a shuttle connectable to the base, the shuttle having an indexing channel which includes a plurality of teeth defining a plurality of index positions;

a height adjustment arm having an indexing rod, the indexing rod engageable with and movable between the plurality of index positions of the indexing channel to adjust a height position of the height adjustment arm relative to the shuttle;

a keyboard support rotatably coupled to the height adjustment arm to adjust a pitch position of the keyboard support relative to the height adjustment arm;

means, coupled to the shuttle, height adjustment arm and keyboard support, for releasably biasing the height adjustment arm to engage the indexing rod with one of the plurality of index positions defined by the plurality of teeth of the indexing channel for locking the height position of the height adjustment arm and the pitch position of the keyboard support, the means being releasable by a force exerted on the keyboard support for adjusting the height position of the height adjustment arm and the pitch position of the keyboard support.

15. The apparatus of claim 14 wherein the plurality of teeth of the indexing channel are angled upward.

16. An apparatus for supporting a keyboard relative to a base, the apparatus comprising:

a shuttle connectable to the base, the shuttle having an indexing channel which includes a plurality of index positions;

a height adjustment arm having an indexing rod, the indexing rod engageable with and movable between the plurality of index positions of the indexing channel to adjust a height position of the height adjustment arm relative to the shuttle;

a keyboard support rotatably coupled to the height adjustment arm to adjust a pitch position of the keyboard support relative to the height adjustment arm; means, coupled to the shuttle, height adjustment arm and keyboard support, for releasably biasing the height adjustment arm to engage the indexing rod with one of the plurality of index positions of the indexing channel for locking the height position of the height adjustment arm and the pitch position of the keyboard support, the means being releasable by a force exerted on the keyboard support for adjusting the height position of the height adjustment arm and the pitch position of the keyboard support, wherein the shuttle has a shuttle pivot hole and the height adjustment arm has an arm slot which is rotatably and slidably coupled to the shuttle pivot hole so that the height adjustment arm slides relative to the shuttle between a locked position where the indexing rod is engaged with one of the plurality of index positions and an unlocked position where the indexing rod is disengaged from the plurality of index positions.

17. The apparatus of claim 16, wherein the indexing channel is curved and substantially centered relative to the shuttle pivot hole.

18. The apparatus of claim 16, wherein the height adjustment arm has an arm guide slot which is curved and substantially centered relative to an arm pivot hole, and the keyboard support has a guide rod which is rotatably and slidably coupled to the arm guide slot so that rotation between the keyboard support and the height adjustment arm relative to the arm pivot hole is coupled with sliding movement of the guide rod relative to the arm guide slot.

19. The apparatus of claim 18 wherein the biasing means couples the movement of the indexing rod of the height adjustment arm relative to the indexing channel of the shuttle to the movement of the guide rod of the keyboard support relative to the arm guide slot of the height adjustment arm for locking and adjusting the height position of the height adjustment arm and the pitch position of the keyboard support.

20. A method for adjusting the position of a keyboard supported on a keyboard support using one hand, the keyboard support being rotatably coupled to a height adjustment arm which is movable relative to a support base for height adjustment, the keyboard support and height adjustment arm being commonly biased by a common biasing mechanism in a first direction toward a locked position locking a height position of the height adjustment arm and an angular position of the keyboard support, the method comprising the steps of:

applying a force on the keyboard support in a second direction which is substantially opposite from the first direction to substantially simultaneously move both the height adjustment arm and the keyboard support to an unlocked position so that the height adjustment arm is movable relative to the support base to adjust the height position and the keyboard support is rotatable relative to the height adjustment arm to adjust the angular position of the keyboard support;

moving the keyboard support relative to the support base with the keyboard support and the height adjustment arm both in the unlocked position to adjust the height of the height adjustment arm and the angular position of the keyboard support; and releasing the force on the keyboard support in the second direction to return the keyboard support and height adjustment arm to the biased locked position.

21. The method of claim 20, wherein the moving step includes rotating the keyboard support relative to the height adjustment arm to adjust a pitch position of the keyboard support.

22. The method of claim 21, wherein the moving step includes substantially simultaneously moving the height adjustment arm relative to the support base to adjust a height position of the keyboard support.

* * * * *